US009664343B2

(12) United States Patent
Knapp et al.

(10) Patent No.: US 9,664,343 B2
(45) Date of Patent: May 30, 2017

(54) UNITARY HEAT SINK FOR SOLID STATE LAMP

(71) Applicant: GE Lighting Solutions, LLC, East Cleveland, OH (US)

(72) Inventors: Thomas Alexander Knapp, Cleveland, OH (US); Thomas Clynne, East Cleveland, OH (US); Jeyachandrabose Chinniah, Katy, TX (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 67 days.

(21) Appl. No.: 14/574,414

(22) Filed: Dec. 18, 2014

(65) Prior Publication Data

US 2016/0178184 A1 Jun. 23, 2016

(51) Int. Cl.

| | |
|---|---|
| ***F21V 29/00*** | (2015.01) |
| ***F21K 9/90*** | (2016.01) |
| ***F21K 9/60*** | (2016.01) |
| ***F21V 29/77*** | (2015.01) |
| ***F21V 29/80*** | (2015.01) |
| ***F21K 9/23*** | (2016.01) |
| *F21Y 115/10* | (2016.01) |
| *F21Y 113/13* | (2016.01) |

(52) U.S. Cl.

CPC ..... *F21K 9/90* (2013.01); *F21K 9/23* (2016.08); *F21K 9/60* (2016.08); *F21V 29/773* (2015.01); *F21V 29/80* (2015.01); *F21Y 2113/13* (2016.08); *F21Y 2115/10* (2016.08)

(58) Field of Classification Search

CPC ..... F21V 29/76; F21V 29/763; F21V 29/77; F21V 29/773; F21V 29/80; F21V 29/81; F21V 23/003; F21K 9/23; F21K 9/232; F21K 9/60; F21K 9/66; F21K 9/68; F21K 9/90; F21Y 2101/00; F21Y 2107/50; F21Y 2113/13; F21Y 2115/10

See application file for complete search history.

(56) References Cited

U.S. PATENT DOCUMENTS

| | | | | |
|---|---|---|---|---|
| 6,301,779 | B1 | 10/2001 | Azar | |
| 7,246,922 | B2 * | 7/2007 | Hulick | F21V 29/80 362/264 |
| 7,654,699 | B2 * | 2/2010 | Chang | F21V 29/02 362/294 |
| 7,922,363 | B2 | 4/2011 | Yang et al. | |
| 7,932,532 | B2 | 4/2011 | Pickard et al. | |
| 8,354,779 | B2 | 1/2013 | Falicoff et al. | |
| 8,362,509 | B2 | 1/2013 | Pickard et al. | |
| 9,091,420 | B2 * | 7/2015 | Woodgate | F21K 9/00 362/249.02 |
| 2008/0024067 | A1 * | 1/2008 | Ishibashi | F21V 29/004 315/112 |

(Continued)

*Primary Examiner* — Alan Cariaso
(74) *Attorney, Agent, or Firm* — GE Global Patent Operation; Peter T. DiMauro

(57) ABSTRACT

A unitary heat sink that includes fins and roots configured to provide improved thermal management for solid state light sources. In an embodiment, the unitary heat sink includes a central hub portion composed of a thermally conducting metal, a plurality of fins projecting away from the central hub portion in a first direction, and a plurality of roots projecting away from the central hub portion in a second direction generally opposite from the first direction.

20 Claims, 17 Drawing Sheets

(56) References Cited

U.S. PATENT DOCUMENTS

| | | | | |
|---|---|---|---|---|
| 2009/0103294 | A1* | 4/2009 | Zhang | F21V 29/004 362/234 |
| 2011/0267821 | A1 | 11/2011 | Van De Ven et al. | |
| 2011/0278633 | A1 | 11/2011 | Clifford | |
| 2011/0310603 | A1* | 12/2011 | Simons | F21K 9/10 362/235 |
| 2012/0163003 | A1* | 6/2012 | Lee | F21V 29/004 362/382 |
| 2012/0250333 | A1* | 10/2012 | Chou | F21V 29/004 362/351 |
| 2014/0126225 | A1* | 5/2014 | Konishi | F21V 29/89 362/373 |
| 2015/0153033 | A1* | 6/2015 | Kuo | F21V 29/24 362/311.02 |

* cited by examiner

UNITARY HEAT SINK FOR SOLID STATE LAMP

FIELD OF THE INVENTION

Embodiments of the present invention generally relate to solid state light source lamps (such as light-emitting diode (LED)-based lamps), and in particular to a unitary heat sink for use with solid state light sources that includes fins and roots configured to provide improved thermal management.

BACKGROUND OF THE INVENTION

Commercial lamps which utilize incandescent, halogen, or high intensity discharge (HID) light sources have relatively high operating temperatures. As a consequence, heat egress is dominated by radiative and convective heat transfer pathways. Thermal management for incandescent, halogen, and HID light sources therefore typically amounts to providing adequate air space proximate the lamp for efficient radiative and convective heat transfer. Thus, it is usually not necessary to increase or modify the surface area of the lamp to enhance the radiative or convective heat transfer to achieve a desired operating temperature for these types of lamps.

As compared to incandescent lamps and halogen lamps, solid-state lighting technologies such as light-emitting diode (LED) devices are highly directional, and thus such devices typically emit light from only one side. But LED-based lamps are more energy efficient than incandescent or halogen lamps, for example, and typically have a longer operating life. In addition, LED-based lamps are durable, can operate under cold or hot temperatures, brighten quickly upon power-up, are ecologically friendly, and utilize low-voltage power supplies. Due to the many advantages associated with LED-based lamps, LED lamps have been produced to replace conventional Edison-base incandescent lamps and halogen light sources.

LED lamps typically operate at substantially lower temperatures for device performance and reliability reasons. For example, the junction temperature for a typical LED device can be below 200° C., and in some LED devices the junction temperatures are below 100° C. or even lower. However, at such low operating temperatures, the radiative heat transfer pathway to the ambient air is weak, so that convective and conductive heat transfer to the ambient air typically dominates. Thus, LED light sources typically utilize a heat sink connected to the LED light source to enhance the convective and radiative heat transfer from the outside surface area of the lamp or luminaire.

A heat sink is a component that provides a large surface area to radiate and/or convect heat away from one or more LED devices. The heat sink is typically a relatively massive metal element that has a large engineered surface area, for example by including fins as heat dissipating structures that radiate outwardly from a surface. A massive heat sink efficiently conducts heat from the LED devices to the fins, and the large surface area of the fins provides efficient heat egress by radiation and convection. In the case of high power LED-based lamps, active cooling elements have been used to enhance heat removal. Examples of active cooling elements include fans, synthetic jets, heat pipes, thermoelectric coolers, and/or pumped coolant fluid.

Another design challenge associated with solid-state lamps is that, unlike an incandescent filament, an LED chip or other solid-state lighting device typically cannot be operated efficiently using standard 110V or 220V alternating current (A.C.) power. Thus, on-board electronic components are needed to convert the A.C. input to direct current (D.C.) power having a lower voltage for driving the LED chips. Such electronic components are typically included within the lamp base (below the heat sink component), in contrast to the simple Edison base used in conventional incandescent lamps or halogen lamps.

Accordingly, LED replacement lamps (to replace, for example, conventional incandescent A19-type light bulbs and/or parabolic aluminized reflector (PAR) type lamps) must balance thermal management principals, such as lamp size constraints, lamp power balance and lamp thermal impedance, and must also consider aesthetics (the shape, size and color characteristics of the LED lamp). In particular, LED replacement lamps have been designed to match "legacy" lamps (such as the A19 soft white light bulb and/or the PAR38 type lamp) in size and shape, in unlit appearance, in lit appearance (i.e., no visible LED dots), in beam distribution, and in color quality. In addition, LED replacement lamps are typically designed to meet "Energy Star" requirements that include having a uniform light intensity plus or minus twenty percent (+/−20%) through a range of vertical angles from zero degrees (0°) to one-hundred and thirty-five degrees (135°), even though LEDs radiate primarily in the forward direction.

As mentioned above, a challenging aspect of LED lamp design for a replacement LED lamp that will be used in an Edison socket concerns managing the waste heat from the LEDs due to the regulated size constraints of the lamp and the insufficient thermal conductance of the Edison base. Thus, a need exists for methods and apparatus to efficiently and inexpensively manage the waste heat from the LEDs of an LED replacement lamp.

SUMMARY OF THE INVENTION

Presented is a unitary heat sink that includes fins and roots, wherein the unitary heat sink is configured to provide improved thermal management for solid state light sources. In an embodiment, the unitary heat sink includes a central hub portion composed of a thermally conducting metal, a plurality of fins projecting away from the central hub portion in a first direction, and a plurality of roots projecting away from the central hub portion in a second direction generally opposite from the first direction.

In an advantageous embodiment, a lamp includes a solid state light source, a unitary heat sink element and a capper. The unitary heat sink element is thermally connected to the solid state light source, and in an implementation includes a central hub, a plurality of fins extending in a first direction from the central hub, and a plurality of roots extending in a second direction from the central hub, the second direction being generally opposite to the first direction. The capper may be configured for seating the roots of the unitary heat sink and for substantially concealing the roots from view of an observer.

BRIEF DESCRIPTION OF THE DRAWINGS

Aspects and/or features of the invention and many of their attendant benefits and/or advantages will become more readily apparent and appreciated by reference to the detailed description when taken in conjunction with the accompanying drawings, which drawings may not be drawn to scale.

DETAILED DESCRIPTION

Incandescent, halogen, and HID light sources are all thermal emitters of light, and the heat transfer to the air space proximate to the lamp is managed by design of the radiative and convective thermal paths to achieve an elevated target temperature during operation of the light source. These light sources are designed to a target temperature that optimizes both the performance and the life of the light source. In contrast, with regard to solid state light sources, such as light-emitting diode (LED) light sources, photons are not thermally-excited but rather are generated by recombination of electrons with holes at the p-n junction of a semiconductor. Thus, both the performance and the life of an LED light source are optimized by minimizing the operating temperature of the p-n junction of the LED, rather than by operating at an elevated target temperature.

As used herein, the term "solid-state light source" (or SSL source) includes, but is not limited to, light-emitting diodes (LEDs), organic light-emitting diode (OLEDs), polymer light-emitting diodes (PLEDs), laser diodes, or lasers. In addition, although the figures depict LED light sources, it should be understood that other types of SSL sources could be utilized in some embodiments in accordance with the novel unitary heat sink implementations described herein.

When designing an LED lamp or luminaire to operate at the lowest possible temperature, the thermal management is typically limited by the surface area of the lamp or luminaire that is in thermal contact with the air space. Thus, a heat sink with fins (or other structures that increase the surface area) is typically provided to enhance the surface area for convective and radiative heat transfer. The surface through which heat is transferred into the surrounding ambient air by convection and/or radiation is the heat sinking surface, and this surface has a large area to provide sufficient heat sinking for the LED devices in steady state operation. Convective and radiative heat sinking into the ambient air from the heat sinking surface can be modeled by thermal resistance or, equivalently, by thermal conductance. Additionally, a thermal conduction path is in series between the LED devices and the heat sinking surface, which represents thermal conduction from the LED devices to the heat sinking surface. A high thermal conductance for this series thermal conduction path ensures that heat egress from the LED to the proximate air via the heat sinking surface is not limited by the series thermal conductance. This is typically achieved by constructing the heat sink as a relatively massive block of metal having fins that define the heat sinking surface. Thus, the metal heat sink body provides the desired high thermal conductance between the LED devices and the heat sinking surface.

Figure 1:
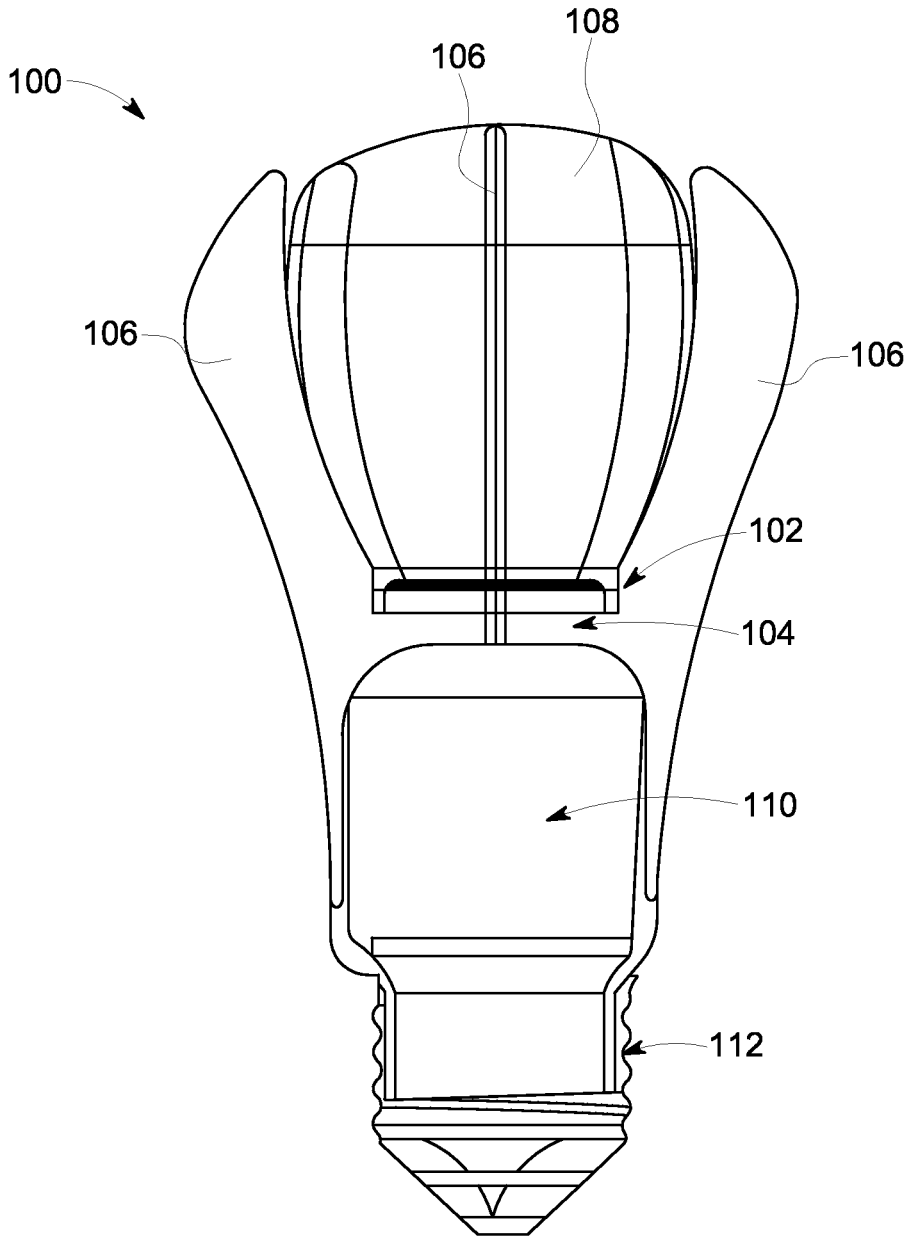
FIG. 1 PRIOR ART
FIG. 1 is a side view of a conventional LED-based lamp designed to be a replacement lamp for a conventional A19 type bulb.

FIG. 1 is a side view of a conventional LED-based lamp 100 which is designed to be a replacement lamp for a conventional A19, 60 Watt (W) bulb typically used in home lighting fixtures such as table lamps. The lamp 100 includes an LED light source 102 having one or more LEDs on a printed circuit board (PCB; not shown), and typically has a 12 W input. The LED light source 102 is in intimate contact with a thermal spreader component 104 which is connected to a plurality of external fins 106 which are directly exposed to ambient air. As shown, the external fins 106 branch radially outwards from the thermal spreader component 104, and together these structures form a heat sink component for the LED lamp 100. A light transmissive envelope 108 surrounds the LED light source 102 and is generally spherical in shape, but it should be understood that other shapes could also provide an appropriate light intensity distribution. A driver housing 110 is located below the PCB board and houses driver circuitry (not shown) that is connected to the LED light source 102. The driver circuitry is also electrically connected to an Edison base 112, which is configured for insertion into a common electrical socket to obtain power to illuminate the LED light source 102 of the lamp 100.

The light transmissive envelope 108 may be a light diffuser, and may be other than a spherical shape, for example, because an alternate shape may improve the interaction between the light transmissive envelope and the heat sink, and/or because a particular shape may be preferable from an appearance standpoint. Thus, the light-transmissive envelope may be a glass element configured to diffuse light, or may be made of plastic or ceramic or a composite material, for example. In some embodiments, the light transmissive envelope may be inherently light-diffusive, or may be frosted or textured to provide light diffusion. For example, a glass material may be provided with a light-diffusive coating such as a Soft-White diffusive coating (available from General Electric Company, New York, USA) of a type used as a light-diffusive coating or light-scattering particles may be embedded in the glass, plastic, or other material of the light-transmissive envelope.

The waste heat from the LED light source 102 of the LED lamp 100 must be managed in view of the insufficient thermal conductance of the Edison base 112. For example, for a twelve Watt (12 W) LED lamp, which provides illumination equivalent to a 60 W incandescent bulb, the lamp power balance is approximately 3 W for the visible light and 9 W of thermal energy. Thus, even at 75 lumens per watt (LPW), three-quarters of the lamp power must be dissipated to ambient air as heat. The LED lamp dissipates heat by conduction, convection and radiation. For example, for a 12 W LED lamp, about 1 W is dissipated by the base component through conduction, 5-6 W are dissipated by the heat sink components through convection, and 2-3 W are dissipated by the heat sink components via radiation. The remainder (3 W) is dissipated by the optics (the LEDs and the light transmissive envelope) in the production of light of approximately 900 lumens. Accordingly, it is clear that the design of the heat sink component is important for such LED-based lamps.

Figure 2:
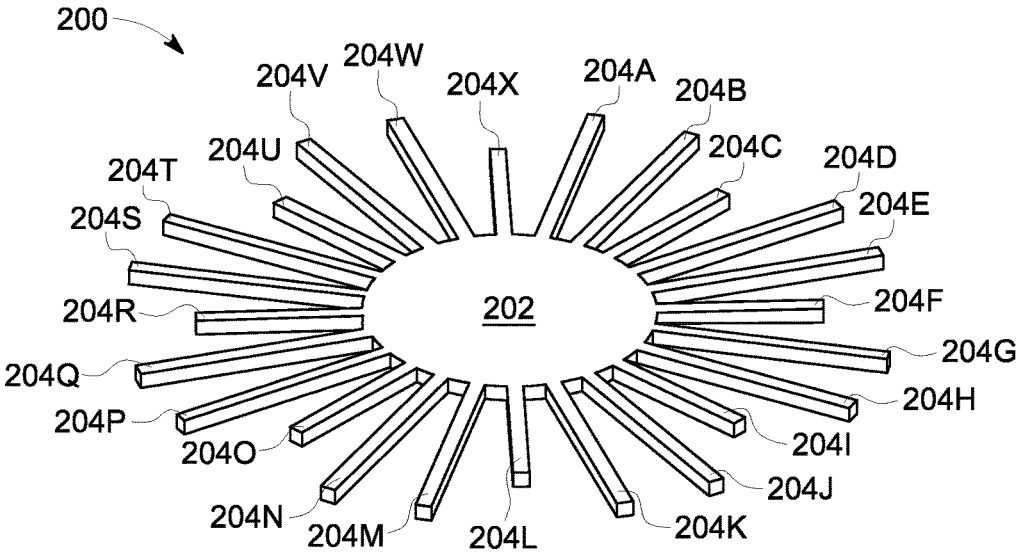
FIG. 2 is a top perspective view of an embodiment of a one-piece or unitary heat sink in accordance with an embodiment of the invention.

FIG. 2 is a top perspective view of an embodiment of a one-piece or unitary heat sink 200 in accordance with embodiments described herein. The unitary heat sink 200 includes a central hub 202 and a plurality of projections 204A to 204X that radiate outwardly from the central hub 202. The heat sink 200 may be stamped-out from one piece of sheet metal material or otherwise formed of one piece of a metallic thermally-conducting material, such as aluminum. In some embodiments, the unitary heat sink 404 may be a stamped aluminum or sheet metal that is approximately 1.5 millimeters (mm) thick, but in some embodiments the thickness may be in the range of from about 0.2 mm to about 4.0 mm. In the embodiment shown in FIG. 2, every third projection, which include the projections 204C, 204F, 2041, 204L, 2040, 204R, 204U and 204X, is shorter than the other projections 204A, 204B, 204D, 204E, 204GF, 204H, 204J, 204K, 204M, 204N, 204P, 204Q, 204S, 204T, 204V and 204W, which may be a design choice dependent on considerations such as the dimensions of the type of lamp in which the unitary heat sink will be utilized and/or the amount of heat dissipation that will be required. Moreover, some projections may be shorter or differently shaped than other projections to improve utilization of sheet metal material and/or to provide a maximum surface area for heat dissipation.

Figure 3:
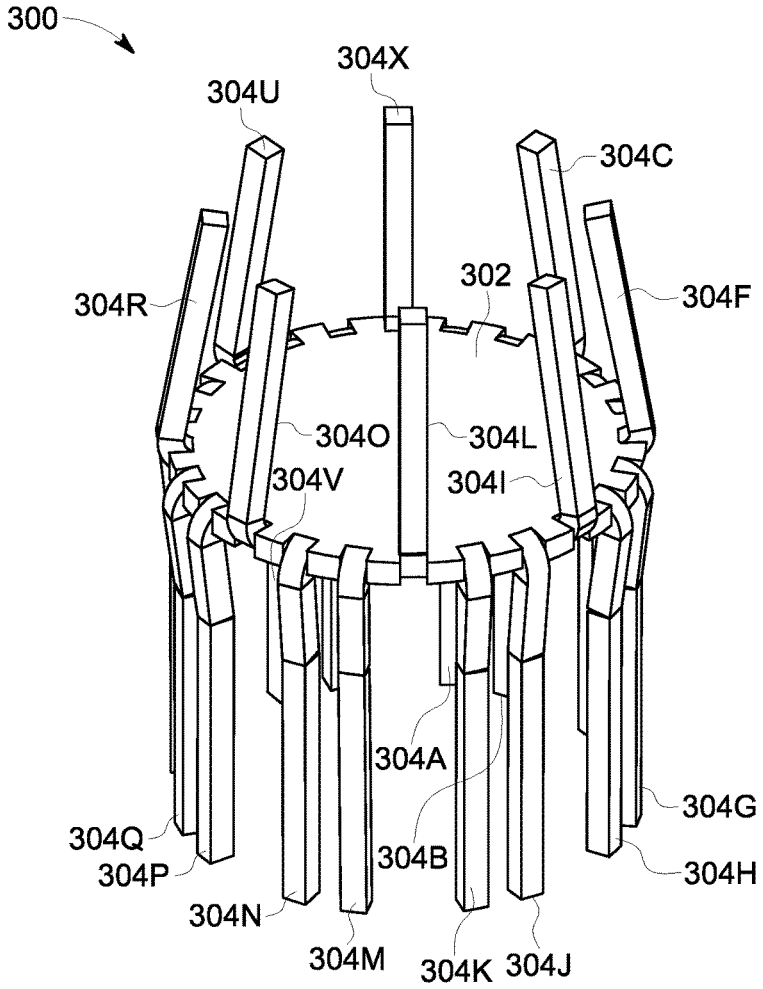
FIG. 3 is an enlarged, top perspective view of a unitary heat sink structure, wherein projections radiating from a central hub have been bent into a plurality of fins and into a plurality of roots in accordance with an embodiment of the invention.

FIG. 3 is an enlarged, top perspective view of a unitary heat sink structure 300 (having the plurality of projections shown in the heat sink of FIG. 2), wherein the projections radiating from a central hub 302 have been bent into a plurality of fins and into a plurality of roots. As shown, the fins are radial projections from the central hub 302 that are bent or formed substantially above the surface of the central hub, whereas the roots are bent or formed substantially below the surface of the central hub. Although the central hub 302 is shown as being substantially circular other types of polygonal shapes are contemplated and could be utilized.

Referring again to FIG. 3, the shorter projections of FIG. 2 (including projections 204C, 204F, 2041, 204L, 2040, 204R, 204U and 204X) have been bent upwards in FIG. 3 into fins 304C, 304F, 3041, 304L, 3040, 304R, 304U and 304X. Similarly, the longer projections of FIG. 2 (including projections 204A, 204B, 204D, 204E, 204G, 204H, 204J, 204K, 204M, 204N, 204P, 204Q, 204S, 204T, 204V and 204W) have been bent downwards in FIG. 3 to form roots 304A, 304B, 304D, 304E, 304G, 304H, 304J, 304K, 304M, 304N, 304P, 304Q, 304S, 304T, 304V and 304W. Both the fins and roots are used for thermal management purposes, to dissipate heat from an LED light source (not shown) when utilized in a lamp assembly. However, the fins may also be used for controlling light distribution of the lamp, as will be explained below. In addition, the roots may also be configured to provide structural support when the unitary heat sink 300 is mounted within a lamp structure or assembly. Thus, the one-piece or unitary heat sink 300 of FIG. 3 is ready for installation, for example, into an LED replacement lamp assembly.

Figure 4:
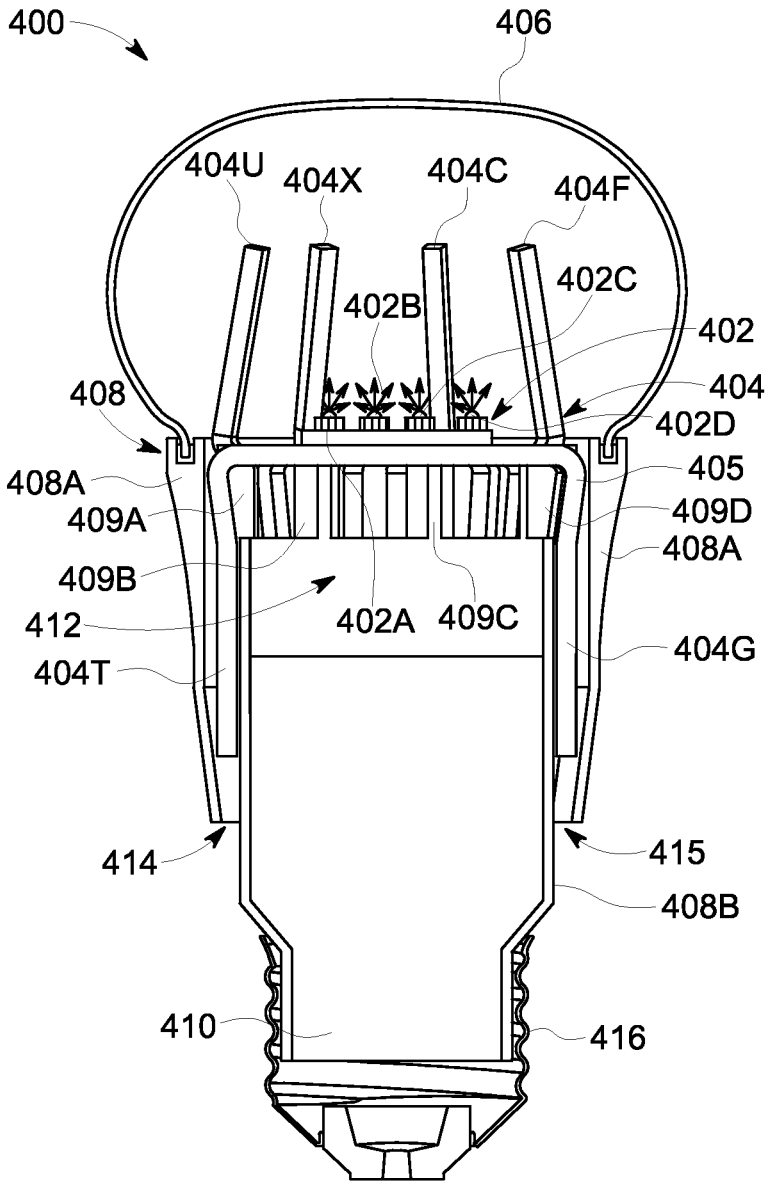
FIG. 4 is a cutaway side view of an LED replacement lamp assembly having a unitary heat sink according to an embodiment of the invention.

FIG. 4 is a cutaway side view of an LED replacement lamp assembly 400 that includes a unitary heat sink 404 in accordance with embodiments described herein (which is similar to the unitary heat sink 300 of FIG. 3). Such an LED lamp may be sized and shaped to replace, for example, an A19 (60 W) incandescent lamp, and may be designed to have an appearance that appeals to consumers. The LED lamp assembly 400 includes a solid state light source 402 that includes LEDs 402A, 402B, 402C and 402D, which is thermally connected to the unitary heat sink 404 which is configured to thermally conduct heat away from the solid state light source. In the embodiment shown, the solid state light source 402 includes a printed circuit board (PCB) and four LEDs thermally connected to the unitary heat sink 404, which is composed of a suitable thermally-conducting material. The central hub portion 405 of the heat sink 404 is shown in cross section, and the central hub portion includes fins 404C, 404F, 404U and 404X that extend in an upward direction. In the embodiment depicted, the all of the fins are entirely enclosed within a volume defined by an optical element 406, which may be, for example, a diffuser, a transparent component, or a lens.

In some embodiments, the fins are configured to permit in the range of at least eighty percent (80%) to ninety-five percent (95%) of the light emitted from the solid state light source 402 to impinge upon the optical element 406, but a lower or a higher percentage of light from the solid state source impinging on the optical element may be desirable in some implementations. But it should be understood that the amount of light emitted from the light engine that reaches the optical element 406 is dependent on the distribution of light emitted by the solid state light source (in FIG. 4, the LEDs), the height of the fins, the shape of the fins, and the reflectance of the fins. For example, in some implementations, the heat sink and/or the fins may be painted or covered with a substance having a reflectance of about ninety-five percent (95%) to about ninety-eight percent (98%), which means that about two percent (2%) to about five percent (5%) of the "first bounce" photons would be absorbed. But if more photon bounces occur then additional absorption would result, which may result in less than 95% of the light from the LED light source from reaching the optical element 406. Thus, if the goal is to permit a high percentage of the light from the LED light source to reach the optical element, then fins that are sufficiently short, thin, and highly reflective should be used. Furthermore, in some embodiments, the fins are entirely concealed from view of a consumer because the optical element is a diffuser having a frosted surface and the fins are configured such that they are not visible to an outside observer. But it should be understood that, in some other embodiments, the fins may be configured so as to be close to a diffuser (and/or touching the diffuser) such that the fins could be visible when the LED light source is OFF and no light is emitted, and/or may be visible because the fins cast a modest shadow when the LED light source is ON. In addition, the fins may be visible if the optical element is, for example, a transparent component (such as a clear glass component) or a lens. Positioning the fins to be close to the diffuser or touching the diffuser may be thermally beneficial because the diffuser has a relatively large surface area in contact with the ambient air. As more thermal energy is transferred from the heat sink fins to the diffuser, that energy may be better dissipated to the ambient environment through convection and radiation, resulting in a more efficient lamp.

Referring again to FIG. 4, the unitary heat sink 404 includes a plurality of roots including roots 404T and 404G that extend in a direction substantially opposite to that of the fins, which in FIG. 4 is a downward direction away from the central hub. In FIG. 4, the diffuser 406 is connected to a one-piece capper 408 which includes a first outer portion 408A and a second inner portion 408B, wherein the first and second capper portions may be connected by ribs 409A, 409B, 409C and 409D. The first capper portion 408A encases the plurality of roots of the unitary heat sink 404 therein and conceals the roots from view by a consumer. The second capper portion 408B defines a first interior volume 410 for housing driver circuitry (not shown), and a second interior volume 412 that may be used to house a larger driver circuit or other components. For example, the interior volume 412 may be utilized to house an active cooling element such as a fan or synthetic jet. In some alternate embodiments, the interior volume 412 may be eliminated. As also shown in FIG. 4, the LED replacement lamp 400 includes a base 416 (or screw cap) which may be configured, for example, as an Edison base for insertion into a standard light socket.

In some embodiments, the solid state lamp assembly 400 includes an air inlet 414 located at a first portion or side of the capper 408, which air inlet may allow ambient air to enter and to circulate about the roots and/or the fins of the unitary heat sink 404 to help cool the solid state light source. In some embodiments, the lamp assembly may also include an air outlet 415 located at a second portion of the capper. In some configurations, the optical element may include an air inlet and/or air outlet (not shown), which may be configured as a vent slit or hole or pattern of holes (which may be small in size so as not to detract from the overall look or impression of the lamp 400). An air inlet and/or air outlet may be especially advantageous in embodiments that employ an active cooling element, such as a fan or synthetic jet, wherein ambient air may be introduced through the inlet and directed to flow past and thus to cool the solid state light source during operation. In embodiments using an air outlet, the ambient air flow may be exhausted outside the lamp through a port or outlet in the capper and/or in the optical element. Thus, an active cooling element and inlet/outlet configuration could significantly (or possibly dramatically) improve the thermal performance of the solid state lamp assembly 400.

Figure 5:
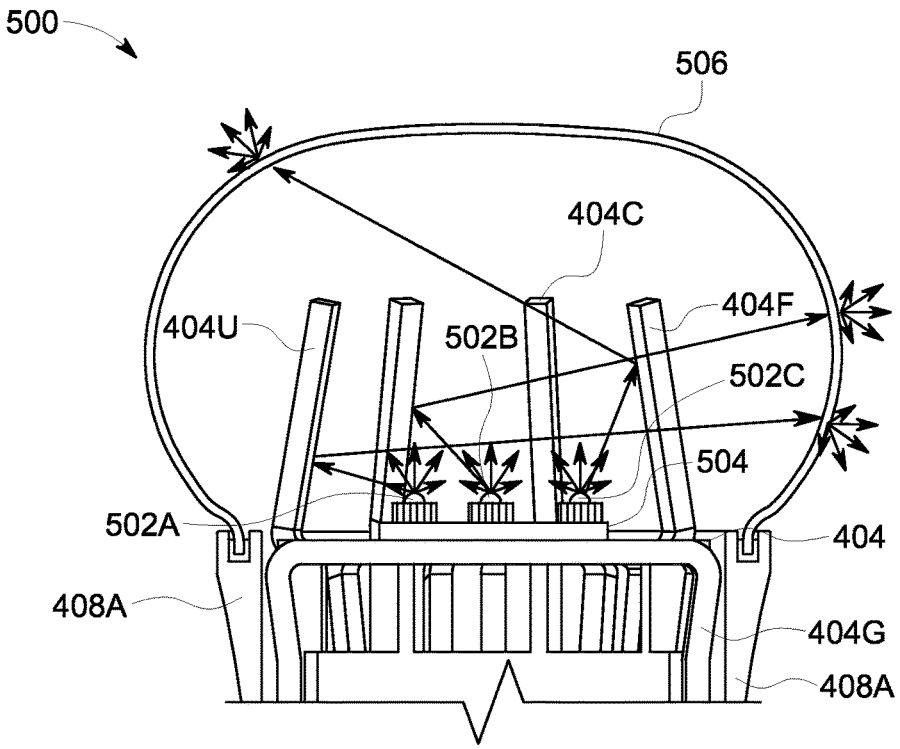
FIG. 5 is an enlarged, cutaway view of a top portion of an LED replacement lamp including a unitary heat sink with fins configured to redirect light from a light source according to an embodiment of the invention.

FIG. 5 is an enlarged, cutaway view of a top portion 500 of an LED replacement lamp including a unitary heat sink according to embodiments described herein, having fins configured to redirect light from a light source; wherein like elements from FIG. 4 are labeled the same. In particular, LEDs 502A, 502B and 502C are shown mounted on a printed circuit board (PCB) 504, which is thermally connected to the unitary heat sink 404. The LEDs 502A, 502B and 502C emit light as shown by the arrows, and some of the emitted light strikes and is reflected by the fins 404U, 404X, 404C and 404F as shown, before impinging on and passing through the diffuser 506. The fins may be configured to redirect light from the light source to assist with achieving omni-directionality. In particular, since LEDs only emit light on one side (upwards as shown by the arrows), it is common to add optical elements to redirect light in any desired directions. However, given a limited volume and shape for achieving a particular light distribution, it can be difficult to design a single optical element (in this case, a diffuser) which functions to direct light evenly in all directions. Thus, the fins 404U, 404X, 404C and 404F (and other fins) may be configured to reflect a portion of the light emitted from the LEDs of the LED light source toward the bottom portion of the diffuser, thereby scattering more light below the light-emitting plane. In addition, the fins may simultaneously and advantageously reduce bright spots from forming directly above the LEDs, thus allowing for even lighting all around the lamp. Moreover, the fins may be configured to assist with color mixing if different LEDs of different colors are used.

Figure 6:
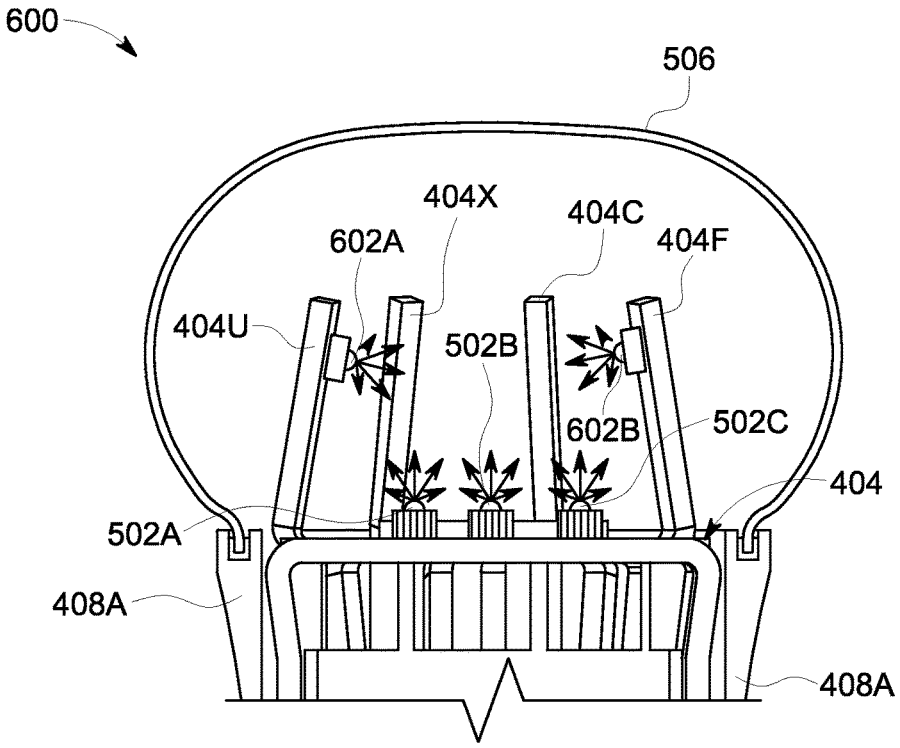
FIG. 6 is an enlarged, cutaway view of a top portion of the LED replacement lamp including a unitary heat sink with fins supporting LED light sources in accordance with an embodiment of the invention.

FIG. 6 is an enlarged, cutaway view of a top portion 600 of the LED replacement lamp including a unitary heat sink 404 with fins 404U and 404F supporting LED light sources 602A and 602B; wherein like elements from FIGS. 4 and 5 are labeled the same. In this embodiment, the unitary heat sink 404 includes a plurality of fins 404U, 404X, 404C and 404F extending into the volume defined by the diffuser 506. In addition, fin 404U includes LED light source 602A and fin 404F includes light source 602B. The LEDs 502A, 502B, 502C, 602A and 602B emit light as illustrated by the arrows, and thus some of the emitted light strikes and is reflected by the fins 404U, 404X, 404C and 404F before impinging on and passing through the diffuser 506, including light from the LEDs 602A and 602B. In this implementation, the sheet metal heat sink 404 includes dielectric and electrically conducting layers so that the LEDs 502A, 502B, 502C, 602A and 602B are mounted directly onto the unitary heat sink. Accordingly, the heat sink and printed circuit board embodiment (for example, as shown in FIG. 5) has been replaced by a single component, and thus the LEDs mounted on the fins are part of the same electrical circuit as the LEDs mounted on the central hub portion of the sheet metal heat sink.

Referring again to FIG. 6, in some embodiments multiple colors of LEDs may be used. For example, a first color may be emitted by LEDs 502A, 502B and 502C located on the central hub portion of the unitary heat sink, whereas a second color may be emitted by the LEDs 602A and 602B positioned on the fins 404U and 404F of the unitary heat sink. In some other embodiments, the LEDs emitting first and second colors may be interspersed throughout the central hub portion and the fins of the unitary heat sink. Further, the shapes of the fins may be configured to control the resultant color emitted by the lamp. For example, a replacement lamp embodiment may be preconfigured to include fins of a particular shape or shapes that could function to mix the LED colors appropriately to achieve the desired result.

Figure 7:
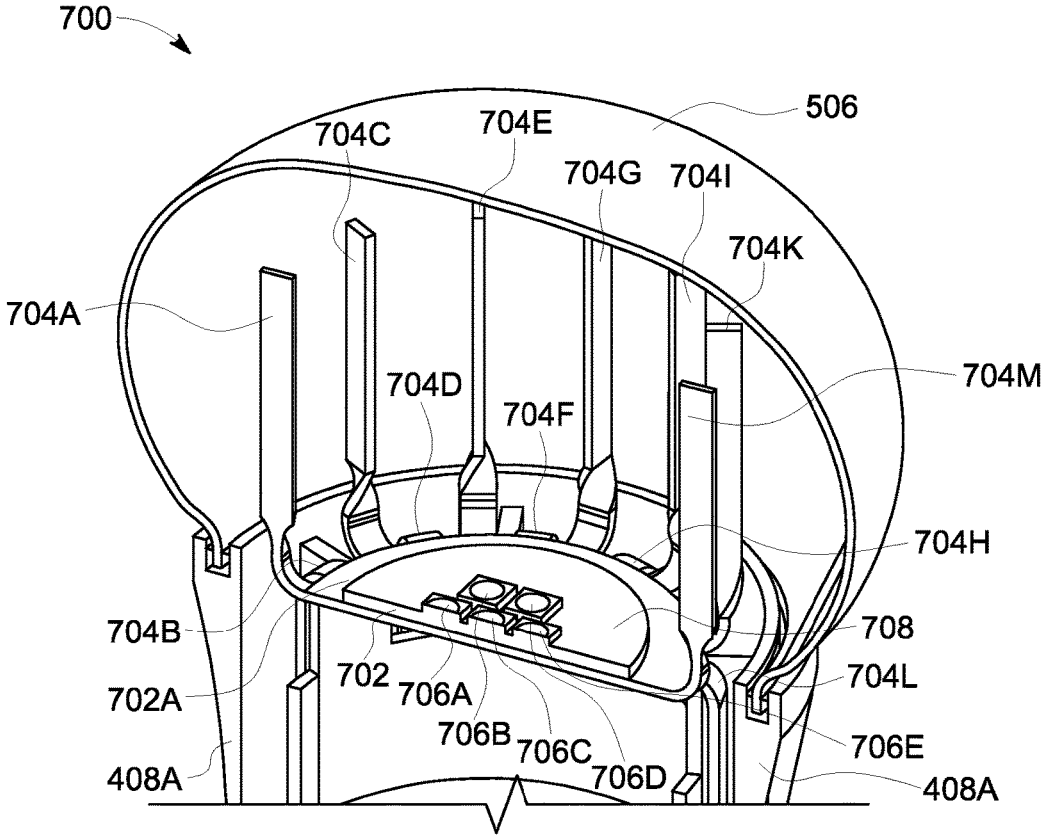
FIG. 7 is an enlarged, perspective, cutaway view of a top portion of an LED replacement lamp which includes a unitary heat sink having a plurality of twisted fins in accordance with an embodiment of the invention.

FIG. 7 is an enlarged, perspective, cutaway view of a top portion 700 of an LED replacement lamp according to an embodiment which includes a unitary heat sink 702 having angled fins 704A, 704C, 704E, 704G, 704I, 704K and 704M according to an embodiment. In some embodiments, the fins are angled and/or curved and/or twisted and/or otherwise shaped to decrease the optical impact (decrease blocking of light from LED light sources) without sacrificing thermal management, and/or to create an omnidirectional or other desired light distribution. In FIG. 7, the fins have been twisted to permit a maximum amount of light emitted from the LED light sources 706A, 706B 706C, 706D and 706E (which are connected to the PCB 708) to reach the diffuser 506. The unitary heat sink 702 also includes roots 704B, 704D, 704F, 704H, 704J and 704L, which protrude in a downward direction within the first capper assembly portion 408A. It should be understood that the LEDs 706A, 706B 706C, 706D and 706E and PCB 708 are thermally connected to the unitary heat sink 702, which operates to thermally conduct heat away from the light source (the LEDs).

Figure 8A:
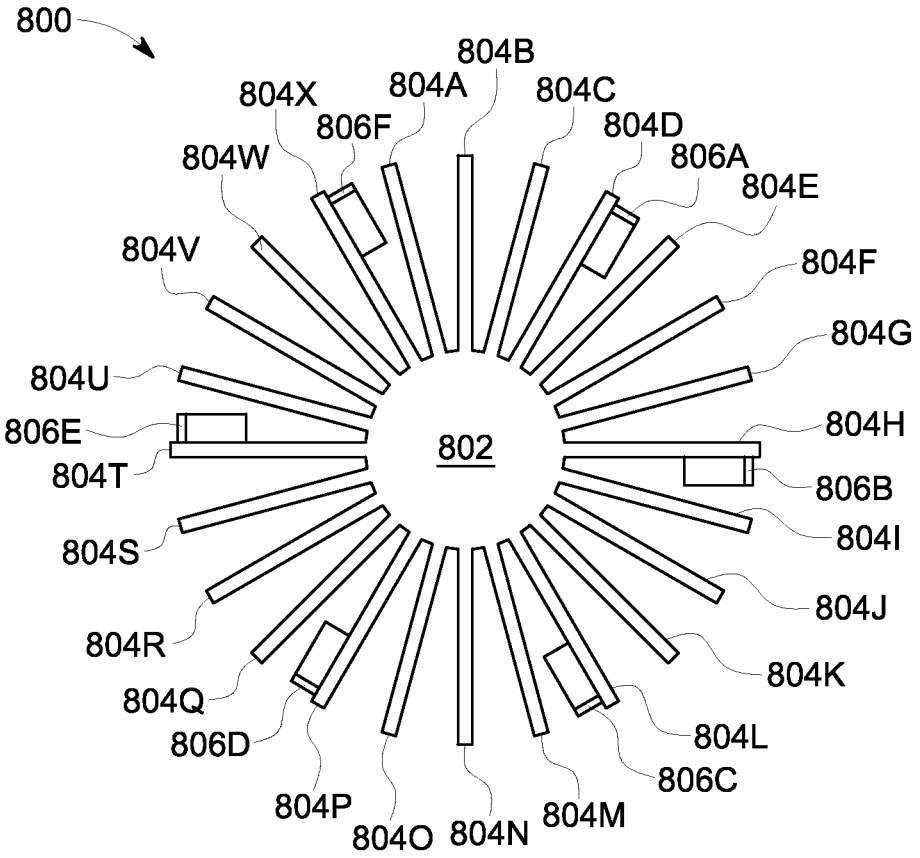
FIG. 8A is an enlarged, top view of a flat unitary heat sink having a plurality of projections (prior to bending) according to an embodiment of the invention.

FIG. 8A is a top view of an embodiment of a one-piece or unitary heat sink 800 in accordance with embodiments described herein. The unitary heat sink 800 includes a central hub 802 and a plurality of projections 804A to 804X that radiate outwardly from the central hub 802. In some implementations, each fourth projection includes a vane 806 (for example, the projection 804D includes vane 806A) that may be configured to redirect light emitted from one or more LEDs of a solid state light source (not shown). The unitary heat sink 800 may be stamped-out from one piece of sheet metal material or otherwise formed of one piece of a metallic thermally-conducting material, such as aluminum, and in some embodiments the sheet metal may be approximately 1.5 mm thick although implementations may be in the range of about 0.2 mm to about 4.0 mm thick. Referring again to FIG. 8A, each of the projections 804A to 804X are of the same length, and every fourth projection, which includes the projections 804D, 804H, 804L, 804P, 804T and 804X includes an associated vane 806A to 806F. In some embodiments, the vanes 806A to 806F are polished to provide a mirror-like surface, and may be adjustable to be bent or otherwise configured as desired for redirecting light emitted from one or more LEDs (not shown).

Figure 8B:
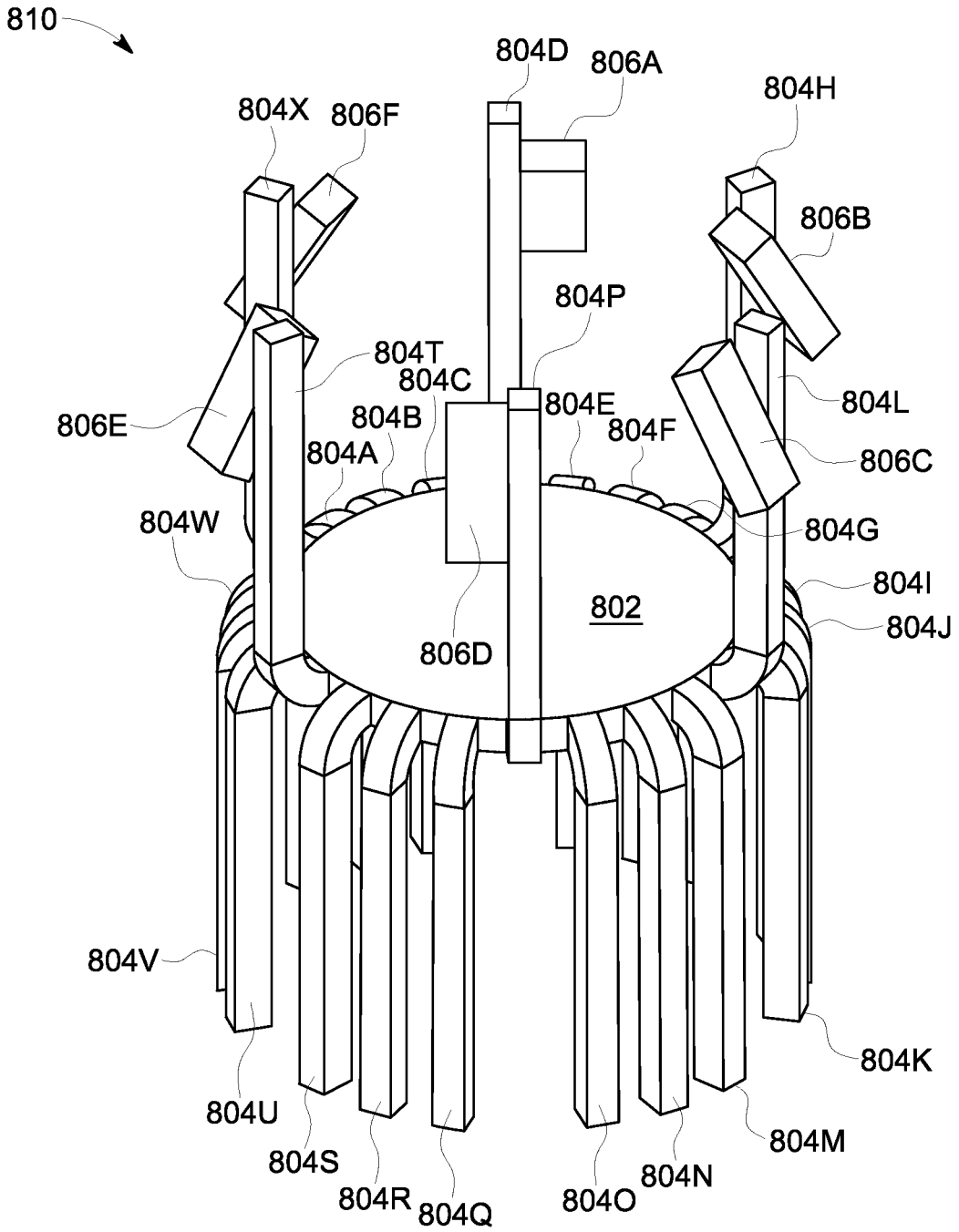
FIG. 8B is an enlarged, top perspective view of the unitary heat sink of FIG. 8A having some of the plurality of projections bent into fins and others of the plurality of projections bent into roots according to another embodiment of the invention.

FIG. 8B is an enlarged, top perspective view 810 of the unitary heat sink structure 800 according to an embodiment. In particular, the projections 804D, 804H, 804L, 804P, 804T and 804X have been bent into a plurality of fins that include associated vanes 806A, 806B, 806C, 806D, 806E and 806F. In addition, the projections 804A, 804B, 804C, 804E, 804F, 804G, 804I, 804J, 804K, 804M, 804N, 8040, 804Q, 804R, 804S, 804U, 804V and 804W have been bent downwards in FIG. 8B to form roots. Both the fins and roots are used for thermal management purposes. However, both the fins 804D, 804H, 804L, 804P, 804T and 804X and associated vanes 806A, 806B, 806C, 806D, 806E and 806F can also be used for controlling the light distribution of a lamp having an LED light source, as explained above (see FIGS. 5 and 6). In addition, the roots may also be configured to provide structural support when the unitary heat sink 810 is mounted within a lamp structure or assembly. Thus, the one-piece or unitary heat sink 810 is ready for installation, for example, into an LED replacement lamp assembly.

Figure 9A:
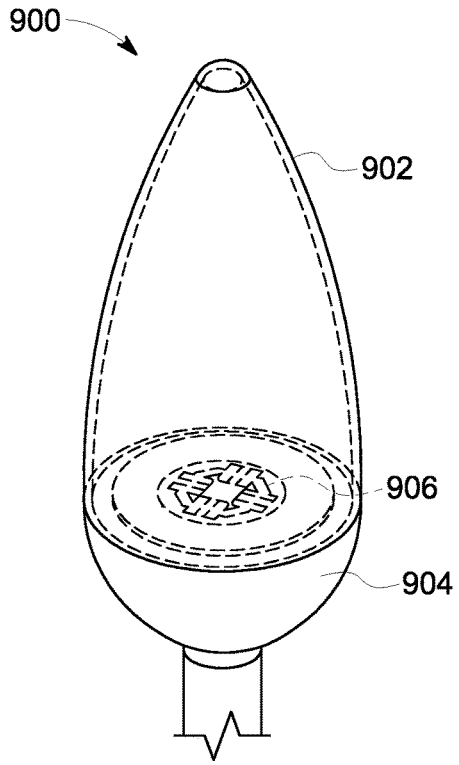
FIG. 9A PRIOR ART
FIG. 9A is a perspective, partial cutaway view of a conventional candlestick lamp having a cone-shaped diffuser.

FIG. 9A is a perspective, partial cutaway view of a conventional candlestick lamp 900 that includes a cone-shaped diffuser 902 connected to a capper 904. A printed circuit board (PCB) 906 houses one or more LEDs (not shown) which operate to generate light when in use.

Figure 9B:
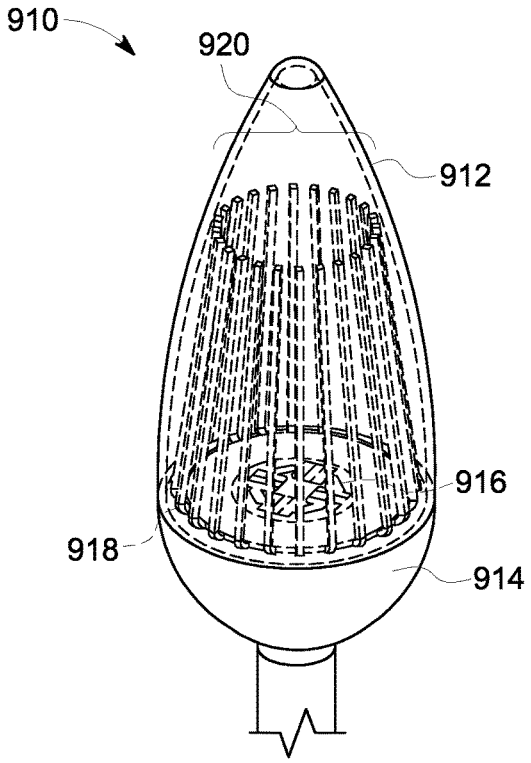
FIG. 9B is a perspective, partial cutaway view of a candlestick lamp having a cone-shaped diffuser and a unitary heat sink according to an embodiment of the invention.

FIG. 9B is a perspective, partial cutaway view of a candlestick lamp 910 in accordance with embodiments described herein. In particular, the candlestick lamp 910 includes a cone-shaped diffuser 912 connected to a capper 914. A PCB 916 houses one or more LEDs (not shown) which operate to generate light when in use, and the PCB 916 and light source are connected to a unitary heat sink 918 having a plurality of fins 920 that are all contained within the volume defined by the diffuser 912. The unitary heat sink 918 may also include a plurality of roots (not shown) that are concealed within the capper 914.

Figure 10A:
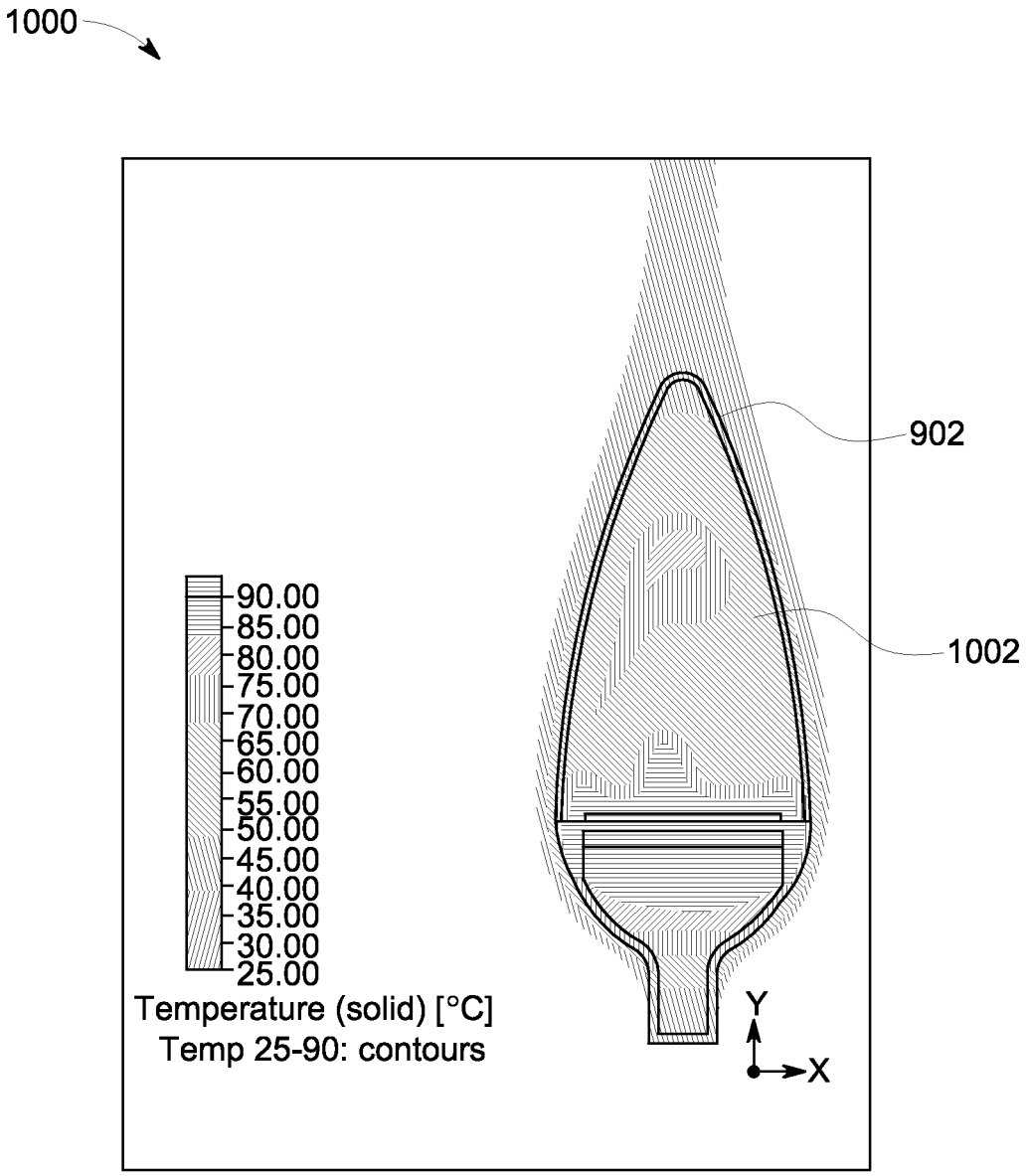
FIG. 10A is a thermal model graph illustrating estimates of heat contours (in degrees Centigrade) of the conventional candlestick lamp of FIG. 9A.
Figure 10B:
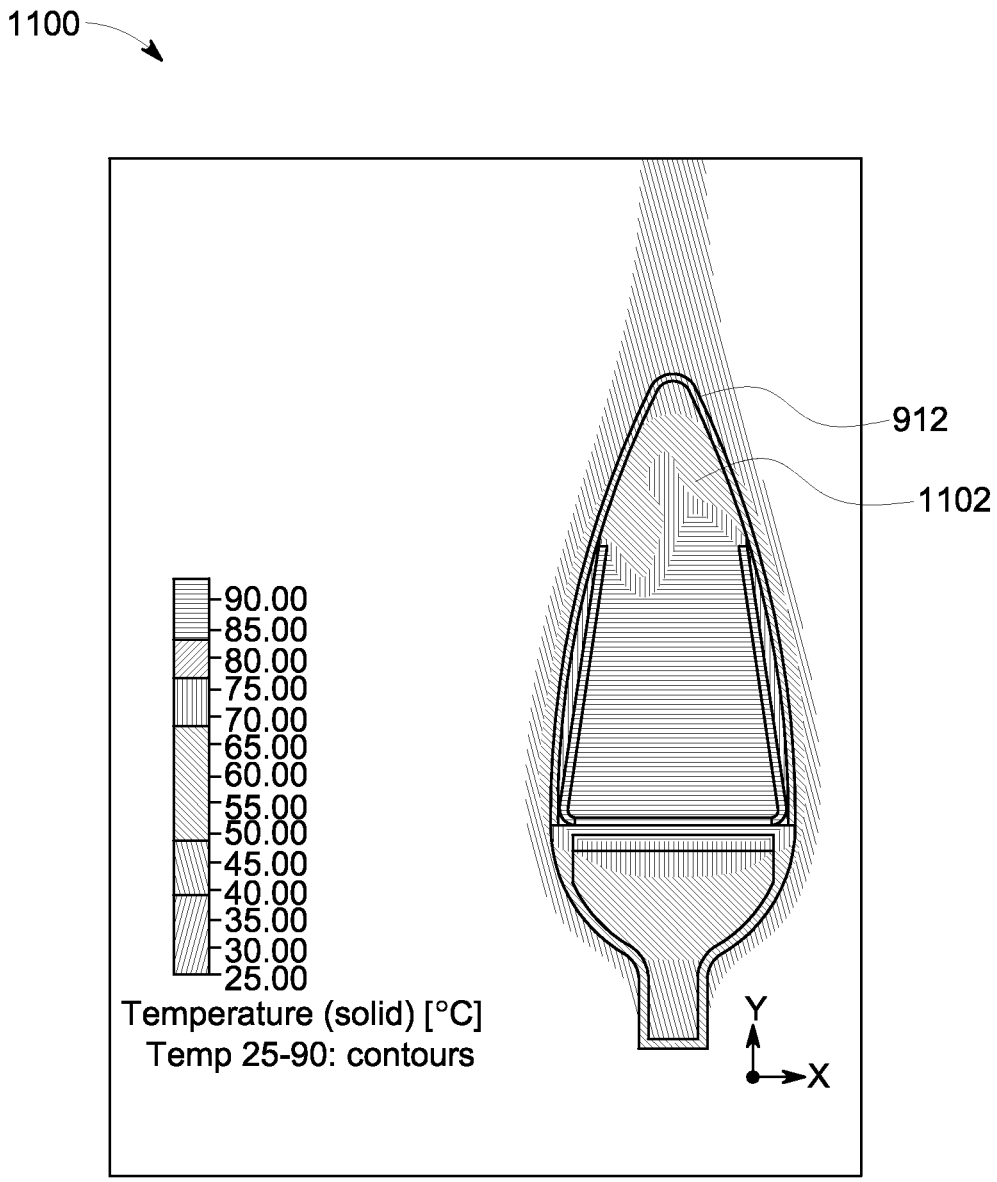
FIG. 10B is a thermal model graph illustrating estimates of the heat contours of the candlestick lamp of FIG. 9B in accordance with embodiments of the invention.

FIG. 10A is a thermal model graph 1000 illustrating estimates of the heat contours (in degrees Centigrade) of the conventional candlestick lamp 900 of FIG. 9A. In this example, the printed circuit board (PCB) is approximately 1 mm thick and the LEDs utilize 3 W of power while the driver circuitry utilizes 0.5 W. In this case, it was found that the average temperature within the volume 1002 of the diffuser 902 was about one hundred and fifty-eight degrees Celsius (158° C.). In contrast, FIG. 10B is a thermal model graph 1100 illustrating estimates of the heat contours of the novel candlestick lamp 910 of FIG. 9B. All of the dimensions associated with FIG. 9A were the same, in that the printed circuit board (PCB) was approximately 1 mm thick and the LEDs utilize 3 W of power while the driver circuitry utilizes 0.5 W. For the novel candlestick lamp 910 that included twenty-four fins within the confines of the diffuser 912, it was found that the average temperature within the volume 1102 of the diffuser 912 was about ninety-nine degrees Celsius (99° C.). This represents approximately a thirty-seven percent (37%) improvement of heat dissapation in comparison to the conventional candlestick lamp 900 of FIG. 9A despite the fact that the fins are enclosed within a diffuser and not exposed directly to ambient air.

Figure 11A:
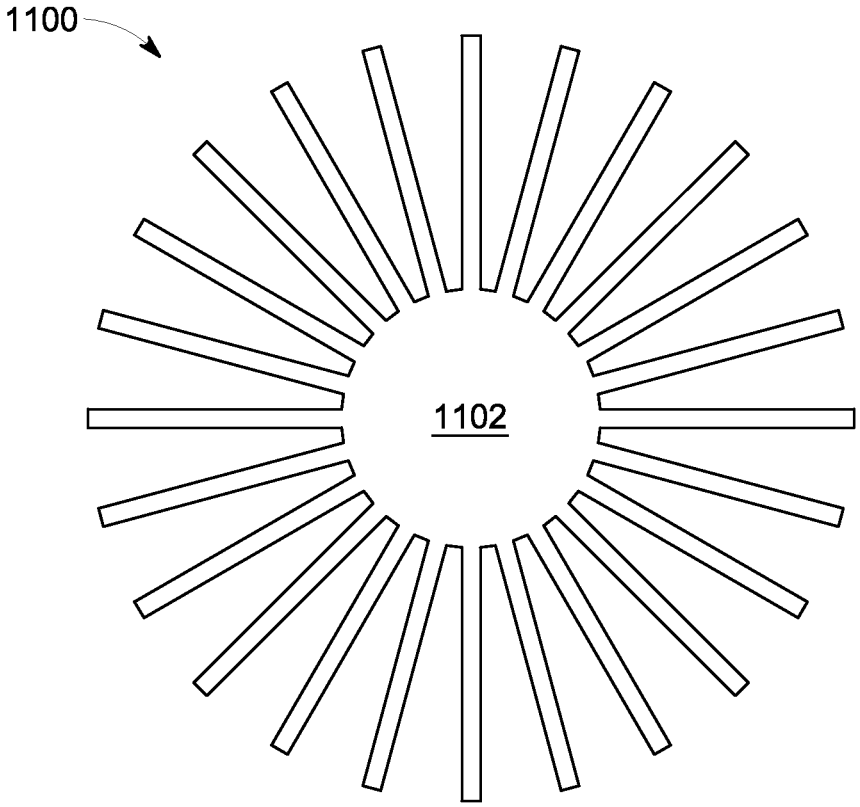
FIG. 11A is a top perspective view of an embodiment of a one-piece or unitary heat sink in accordance with another embodiment of the invention.

FIG. 11A is a top perspective view of an embodiment of a one-piece or unitary heat sink 1100 in accordance with embodiments described herein. The unitary heat sink 1100 includes a central hub 1102 and a plurality of projections that radiate outwardly from the central hub as shown. Although the central hub 1102 is shown as being substantially circular other types of polygonal shapes are contemplated and could be utilized. The heat sink 1100 may be stamped-out from one piece of sheet metal material or otherwise formed of one piece of a metallic thermally-conducting material, such as aluminum. In some embodiments, the unitary heat sink 1100 may be a stamped aluminum or sheet metal that is approximately 1.5 millimeters (mm) thick, but the thickness of the unitary heat sink may be in the range of from about 0.2 mm to about 4.0 mm. In the embodiment shown in FIG. 11A, each of the projections is the same length, which may be a design choice dependent on considerations such as the dimensions of the type of lamp in which the unitary heat sink will be utilized and/or the amount of heat dissipation that will be required.

Figure 11B:
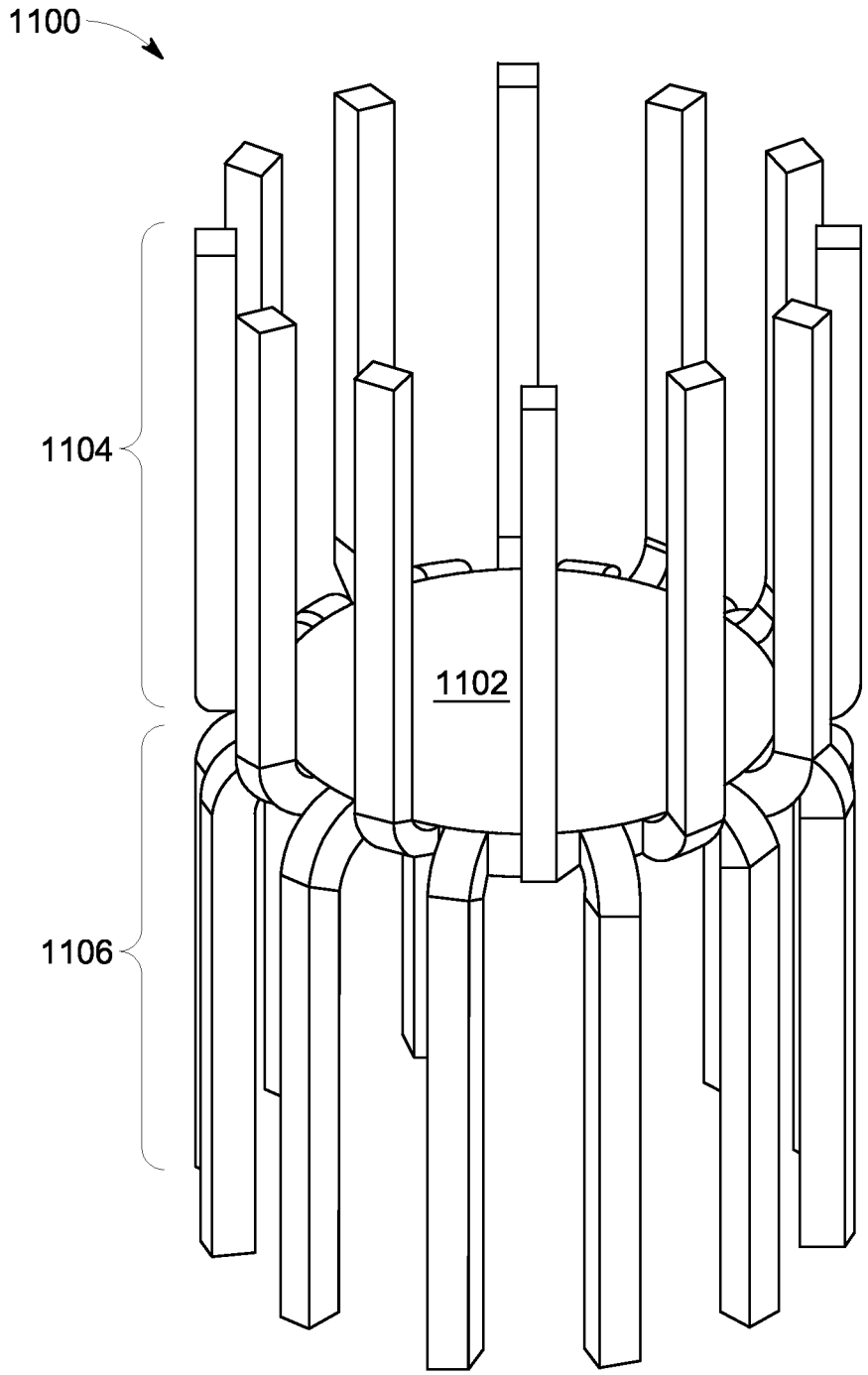
FIG. 11B is top perspective view of the unitary heat sink of FIG. 11A, wherein projections radiating from a central hub have been bent into a plurality of fins and into a plurality of roots in accordance with an embodiment of the invention.

FIG. 11B is an enlarged, top perspective view of the unitary heat sink structure 1100 of FIG. 11A wherein half of the projections radiating from the central hub 1102 have been bent into a plurality of fins 1104 and the other half bent into a plurality of roots 1106. As shown, the fins are radial projections from the central hub 1102 that are bent or formed substantially above the surface of the central hub, whereas the roots are bent or formed substantially below the surface of the central hub 1102. Both the fins and roots are used for thermal management purposes, to dissipate heat from a solid state light source (not shown) when utilized in a lamp assembly. In addition, the fins may be used for controlling light distribution of the lamp, as explained above, and the roots may be configured to provide structural support when the unitary heat sink 1100 is mounted within a lamp structure or assembly. Thus, the one-piece or unitary heat sink 1100 of FIG. 11B is ready for installation, for example, into an LED replacement lamp assembly.

Figure 12A:
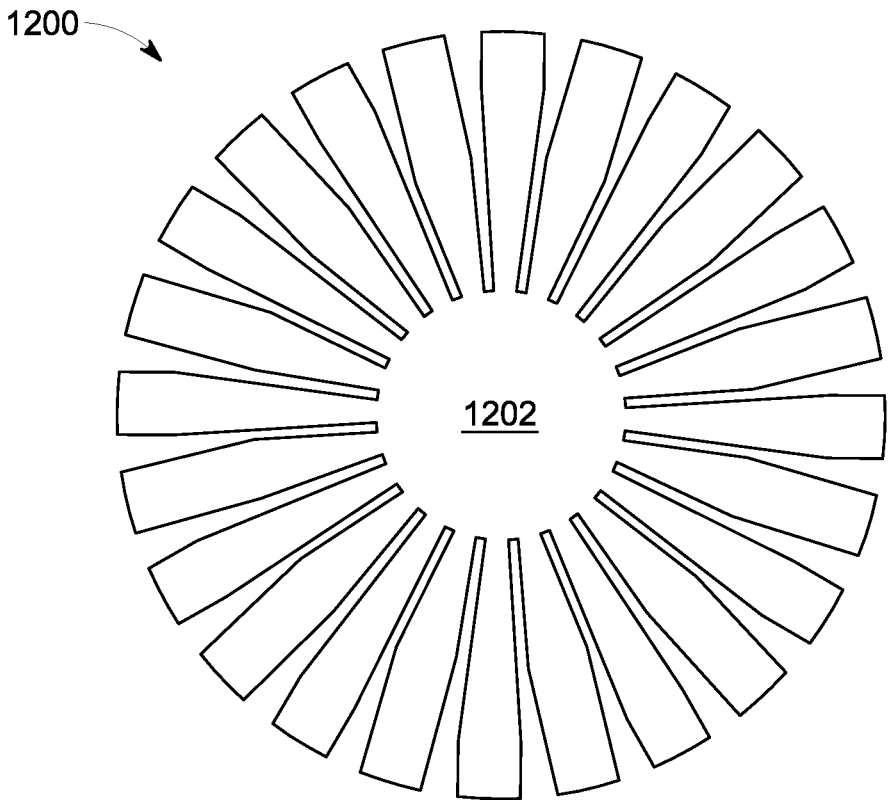
FIG. 12A is a top perspective view of yet another embodiment of a one-piece heat sink illustrating increased sheet metal utilization in comparison to the unitary heat sink shown in FIGS. 11A and 11B.

FIG. 12A is a top perspective view of another embodiment of a one-piece or unitary heat sink 1200 that increases sheet metal utilization in comparison to the unitary heat sink 1100 of FIGS. 11A and 11B. The unitary heat sink 1200 includes a central hub 1202 and a plurality of projections that radiate outwardly from the central hub as shown. Although the central hub 1202 is shown as being substantially circular other types of polygonal shapes are contemplated and could be utilized. The heat sink 1200 may be stamped-out from one piece of a sheet metal material or otherwise formed of one piece of a metallic thermally-conducting material, such as aluminum. In some embodiments, the unitary heat sink 1200 may be a stamped aluminum or sheet metal that is approximately 1.5 millimeters (mm) thick, but the thickness of the unitary heat sink may be in the range of from about 0.2 mm to about 4.0 mm. As shown in FIG. 12A, each of the projections is thicker than the projections of FIG. 11A, which improves sheet metal material utilization and heat dissipation. Although the projections are of the same length, in some embodiments projections of varying length may be used which configuration may depend on considerations such as the dimensions of the type of lamp in which the unitary heat sink 1200 will be utilized and/or the amount of heat dissipation that will be required.

Figure 12B:
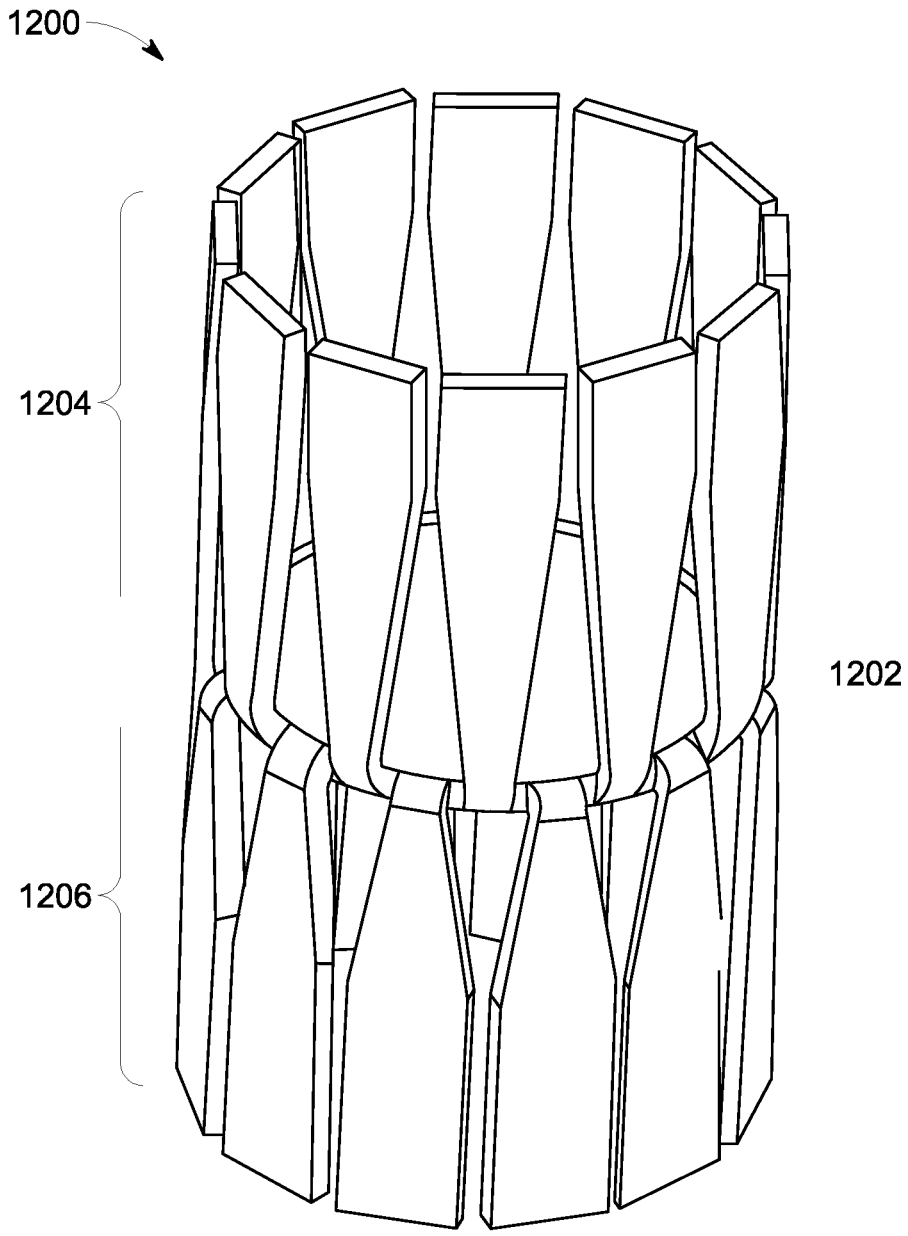
FIG. 12B is an enlarged, top perspective view of the unitary heat sink structure of FIG. 12A.

FIG. 12B is an enlarged, top perspective view of the unitary heat sink structure 1200 of FIG. 12A wherein half of the projections radiating from the central hub 1202 have been bent into a plurality of fins 1204 and the other half bent into a plurality of roots 1206. As shown, the fins 1204 are radial projections from the central hub 1202 that are bent or formed substantially above the surface of the central hub, whereas the roots 1206 are bent or formed substantially below the surface of the central hub 1202. Both the fins and roots are used for thermal management purposes, to dissipate heat from a solid state light source (not shown) when utilized in a lamp assembly. In addition, the fins 1204 may be used for controlling light distribution of the lamp, as explained herein, and the roots 1206 may be configured to provide structural support when the unitary heat sink 1200 is mounted within a lamp structure or assembly. Thus, the one-piece or unitary heat sink 1200 of FIG. 12B is ready for installation, for example, into an LED replacement lamp assembly.

Figure 12C:
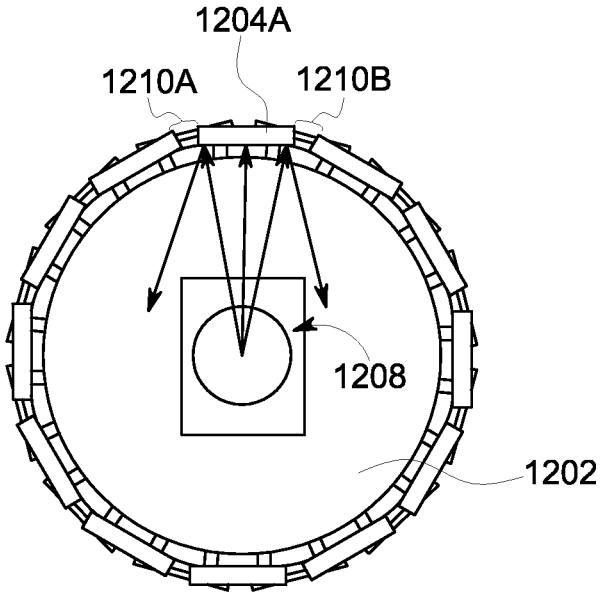
FIG. 12C is a top view of the unitary heat sink structure 12B illustrating how the relatively thick fins obstruct a portion of the optical path of light emitted from a solid state light source.

FIG. 12C is a top view of the unitary heat sink structure 1200 of FIG. 12B to illustrate how the relatively wide fins 1204 obstruct a portion of the optical path of light emitted from a solid state light source, such as an LED light source 1208, which may be present on the surface of the central hub 1202 as shown. In particular, the openings 1210A and 1210B on either side of the fin 1204A are small in comparison to the width of the fin. Thus, a relatively large portion of the light emitted by the LED light source 1208 in the direction of the fin 1204A, which light is represented by arrows in FIG. 12C, impinges on the fin 1204A and is directed back into the lamp instead of being emitted by the lamp. Thus, although this untwisted fin configuration of FIGS. 12B and 12C provides increased heat dissipation due to the increased surface area of the fins and roots in comparison to the fins and roots of the unitary heat sink 1100 of FIG. 11B, the increased surface area of the metallic fins also blocks a larger portion of the light from the solid state light source that otherwise would be emitted by the solid state lamp, which may be undesirable or less than optimal in some implementations.

Figure 12D:
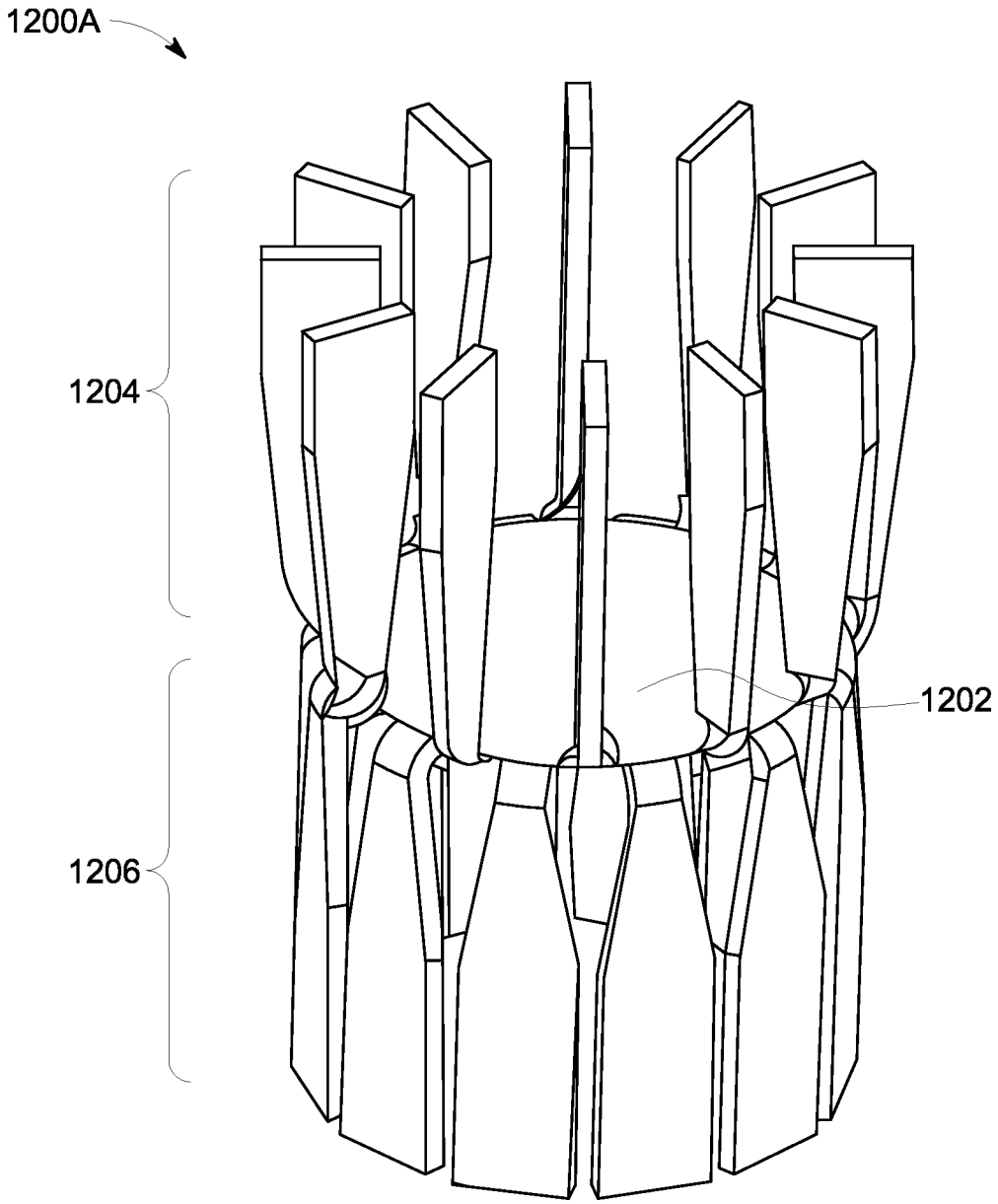
FIG. 12D is an enlarged, top perspective view of another unitary heat sink structure similar to that shown in FIG. 12B, but wherein the fins have been twisted about ninety degrees.

FIG. 12D is an enlarged, top perspective view of a unitary heat sink structure 1200A that is similar to that shown in FIG. 12B, wherein half of the projections radiating from the central hub 1202 have been bent into a plurality of fins 1204 and the other half bent into a plurality of roots 1206. However, FIG. 12D shows that the fins 1204 projecting from the central hub 1202 have been twisted approximately ninety degrees, and the roots 1206 have been bent downwards below the surface of the central hub 1202 in the same manner as the roots shown in FIG. 12B. As mentioned above, both the fins and roots are used for thermal management purposes, to dissipate heat from a solid state light source (not shown) when utilized in a lamp assembly. In this embodiment, the fins 1204 have been twisted as shown to reduce optical obstruction of light from a solid state light source (which will be explained below) while at the same time maintaining, or possibly improving, thermal dissipation. As also mentioned above, the roots 1206 may be configured to provide structural support when the unitary heat sink 1200 is mounted within a lamp structure or assembly. Thus, the one-piece or unitary heat sink 1200 of FIG. 12D is ready for installation, for example, into an LED replacement lamp assembly.

Figure 12E:
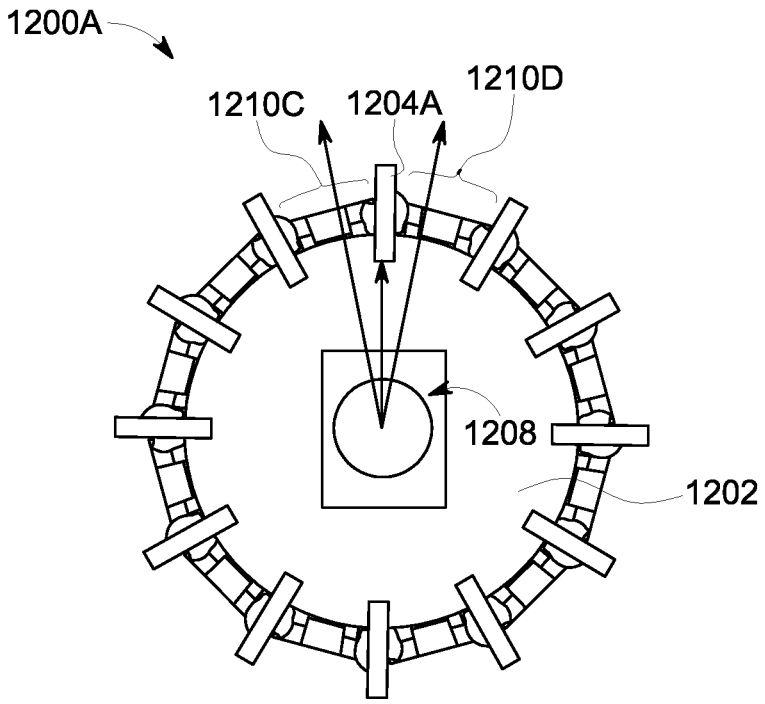
FIG. 12E is a top view of the unitary heat sink structure of FIG. 12D illustrating how the twisted fin configuration obstructs less light from a solid state light source than the untwisted fin configuration shown in FIGS. 12B and 12C.

FIG. 12E is a top view of the unitary heat sink structure 1200 of FIG. 12D to illustrate that the twisted fin configuration obstructs less light from a solid state light source than the untwisted fin configuration shown in FIGS. 12B and 12C. In particular, an LED light source 1208 present on the surface of the central hub 1202 emits light represented by the arrows shown in FIG. 12E. As shown, the openings 1210C and 1210D on either side of the fin 1204A are large in comparison to the width of the fin 1204A, and thus a relatively large portion of the light emitted by the LED light source 1208 in the direction of the fin 1204A is permitted to pass through and be emitted by the lamp. The openings 1210C and 1210D are also larger than the openings 1210A and 1210B shown in FIG. 12C, and thus more light from the from the solid state light source 1208 is allowed to pass through to the optical element (not shown) and escape as emitted light from the lamp in comparison to the untwisted fin configuration shown in FIG. 12C. In addition, the twisted fin configuration 1200A provides increased heat dissipation in comparison to the unitary heat sink 1100 of FIG. 11B.

It should be understood that other types of unitary heat sink designs are possible that include fins and roots in accordance with the examples described herein. For example, a unitary heat sink may include one or more fins that are bent and/or otherwise shaped to extend outside the volume defined by a diffuser. For example, one or more fins (or a minority of the fins available of a particular configuration) may be bent or otherwise configured to be positioned or located alongside an outside surface of the diffuser of a lamp assembly. For example, a diffuser may include one or more recessed portions along the outside surface that are shaped and/or sized to accept one or more fins on the outside surface of the diffuser. Similarly, a unitary heat sink may include one or more roots that are bent and/or otherwise shaped to extend outside the volume defined by the capper. For example, one or more roots may be bent or otherwise configured to be positioned alongside an outside surface of the capper when a lamp is assembled, and/or may be configured to fit within a recessed portion of an outside portion of the capper.

Unitary heat sinks having fins and roots in accordance with embodiments described herein provide improved thermal management in comparison to conventional heat sink designs. In addition, due to the compact shape and configuration of the unitary heat sink, in some embodiments no fasteners are required, there is extra room available under the heat sink that may be utilized to design a more compact replacement lamp, and smaller or more compact driver circuitry can be utilized. Additionally, in some embodiments, active cooling elements such as fans or synthetic jets may be disposed within the lamp volume to further improve the thermal dissipation of the fins and roots of the unitary heat sink. Furthermore, using sheet metal instead of a casting to form the unitary heat sink allows more complex shapes to be created via bending or other forming techniques. Complex shapes may therefore be utilized to control optical distribution to improve the omni-directionality of emitted light from the LEDs, or may be shaped to be minimally invasive to the optical path, thereby optimizing or maximizing optical efficiency.

The above description and/or the accompanying drawing is not meant to imply a fixed order or sequence of steps for any process referred to herein; rather any process may be performed in any order that is practicable, including but not limited to simultaneous performance of steps indicated as sequential.

Although the present invention has been described in connection with specific exemplary embodiments, it should be understood that various changes, substitutions, and alterations apparent to those skilled in the art can be made to the disclosed embodiments without departing from the spirit and scope of the invention as set forth in the appended claims.

What is claimed is:

1. A lamp comprising:

a solid state light source;

a unitary heat sink element thermally connected to the solid state light source, the unitary heat sink comprising a central hub, a plurality of fins extending in a first direction from the central hub and a plurality of roots extending in a second direction from the central hub, the second direction being generally opposite to the first direction;

a capper configured for seating the roots of the unitary heat sink and for substantially concealing the roots from view; and an optical element connected to the capper, the optical element surrounding the solid state light source and defining a volume therein, wherein the fins of the unitary heat sink are positioned substantially within the volume.

2. The lamp of claim 1, wherein the fins are configured to permit in the range of at least about eighty-percent to about ninety-five percent of light emitted from the solid state light source to impinge on the optical element.

3. The lamp of claim 1, wherein the number of fins equals the number of roots extending from the central hub of the unitary heat sink.

4. The lamp of claim 1, wherein at least twice as many roots extend from the central hub as fins.

5. The lamp of claim 1, wherein at least a portion of the fins have a length shorter than the length of the roots.

6. The lamp of claim 1, wherein at least a portion of the roots have a length shorter than the length of the fins.

7. The lamp of claim 1, wherein the solid state light source comprises at least one solid state light source of at least a first color mounted on the central hub.

8. The lamp of claim 7, further comprising at least one solid state light source mounted on at least one fin.

9. The lamp of claim 8, wherein the at least one solid state light source mounted on the at least one fin is of a second color different from the first color.

10. The lamp of claim 7, further comprising a first solid state light source of a first color mounted on a first fin and a second solid state light source of a different, second color mounted on a second fin, wherein the first fin and the second fin are shaped for mixing a first color light and a second color light providing a desired resultant color light.

11. The lamp of claim 1, further comprising at least one vane mounted on at least one fin to optically redirect at least a portion of light emitted from the solid state light source.

12. The lamp of claim 1, wherein at least one of the plurality of fins is positioned to redirect a portion of light emitted by the solid state light source.

13. The lamp of claim 1, further comprising an air inlet proximate a portion of the capper.

14. The lamp of claim 13, further comprising an air outlet proximate a second portion of the capper.

15. The lamp of claim 13, further comprising an air outlet in the optical element.

16. The lamp of claim 1, wherein at least one fin is configured for positioning on an outside surface of the diffuser.

17. The lamp of claim 1, further comprising driver circuitry operably connected to the solid state light source and housed in the capper.

18. The lamp of claim 17, further comprising a base connected to the capper and operably connected to the driver circuitry.

19. A unitary heat sink comprising:

a central hub portion composed of a thermally conducting metal;

a plurality of fins of the thermally conducting metal, the fins projecting away from the central hub portion in a first direction, wherein at least one of the plurality of fins is configured for redirecting light;

at least one solid state light source mounted on at least one fin of the plurality of fins; and a plurality of roots of the thermally conducting metal, the roots projecting away from the central hub portion in a second direction generally opposite from the first direction.

20. A method of forming a lamp, comprising:

providing a solid state light source;

thermally connecting the solid state light source to a unitary heat sink element, wherein the unitary heat sink comprises a central hub, a plurality of fins extending in a first direction from the central hub and a plurality of roots extending in a second direction from the central hub, the second direction being generally opposite to the first direction;

connecting the roots of the unitary heat sink to a capper such that the roots are substantially concealed from view; and connecting an optical element to an upper portion of the capper to encase the solid state light source and the fins of the unitary heat sink.

* * * * *